US008347776B2

(12) United States Patent
Frey et al.

(10) Patent No.: US 8,347,776 B2
(45) Date of Patent: Jan. 8, 2013

(54) VEHICLE ATTACHED GUN MOUNT

(75) Inventors: David C. Frey, Traverse City, MI (US); Richard J. Nowicki, Grand Haven, MI (US)

(73) Assignee: Milton Manufacturing, Inc., Detroit, MI (US)

( * ) Notice: Subject to any disclaimer, the term of this patent is extended or adjusted under 35 U.S.C. 154(b) by 195 days.

(21) Appl. No.: 13/012,520

(22) Filed: Jan. 24, 2011

(65) Prior Publication Data

US 2012/0186438 A1 Jul. 26, 2012

(51) Int. Cl.
*F41A 23/52* (2006.01)

(52) U.S. Cl. ..... 89/37.13; 89/40.03

(58) Field of Classification Search ..... 89/37.16, 89/37.21, 37.22, 37.03, 37.13, 40.03, 40.15
See application file for complete search history.

(56) References Cited

U.S. PATENT DOCUMENTS

| | | | | |
|---|---|---|---|---|
| 426,482 | A | 4/1890 | Very | |
| 1,333,446 | A * | 3/1920 | Ross | 89/40.03 |
| 2,415,340 | A | 2/1947 | D'Ardenne et al. | |
| 3,235,997 | A | 2/1966 | Stoner | |
| 4,686,888 | A | 8/1987 | Sanborn et al. | |
| 5,002,216 | A | 3/1991 | Gerber | |
| 6,393,960 | B1 | 5/2002 | Bilger | |
| 7,086,192 | B2 | 8/2006 | Deros | |
| 7,210,391 | B2 | 5/2007 | Beckmann | |
| 7,934,445 | B2 * | 5/2011 | McClellan | 89/40.06 |
| 2004/0237372 | A1 | 12/2004 | Frye | |
| 2007/0051235 | A1 | 3/2007 | Hawkes et al. | |
| 2007/0131103 | A1 * | 6/2007 | McClellan et al. | 89/37.03 |
| 2008/0202326 | A1 | 8/2008 | Carroll et al. | |

* cited by examiner

*Primary Examiner* — Stephen M Johnson
(74) *Attorney, Agent, or Firm* — Harness, Dickey & Pierce, P.L.C.

(57) ABSTRACT

A gun mount for mounting a weapon to a vehicle includes a weapon mount plate defining a planar surface. First and second side plates are oriented at an angle to the weapon mount plate planar surface. Front and rear plates are perpendicular to the weapon mount plate and the first and second side plates supporting the weapon mount plate and fixed to the first and second side plates. A male tab extends from both the first and second side plates. A female slot is created in individual ones of both the front and rear plates. The female slot is aligned to slidably receive the male tab with a male tab freely extending portion extending beyond the female slot. A tab weld joint created at the freely extending portion of the male tab fixes the first and second side plates to the front and rear plates.

20 Claims, 9 Drawing Sheets

VEHICLE ATTACHED GUN MOUNT

FIELD

The present disclosure relates to structural assemblies connected to a vehicle used to mount a weapon to the vehicle.

BACKGROUND

This section provides background information related to the present disclosure which is not necessarily prior art.

Weapons such as machine guns, automatic weapons having belted ammunition, flame throwers, gatling guns, and the like that are not easily manually transported are often mounted to small, un-armored, or lightly armored vehicles to support the weight of the weapon and provide for rapid deployment. Structure used to mount the weapon needs to accommodate the weight and firing loads of the weapon while minimizing the weight impact to the vehicle. It is therefore common for multiple leg mounts such as tripods to be used both to provide elevation of the weapon and to distribute the loads to the vehicle, or for tubular mounts to be used.

Multiple leg mounts provide point loading at the contact area of the legs. When a plate is used as the main contact point, even with multiple legs used for extending the weapon, the plate can produce localized high stress areas at the plate connection joint or at points of contact of the structure with the vehicle. In addition, common weapon mounts that are welded use continuous weld joints that increase both a construction cost and mount weight.

SUMMARY

This section provides a general summary of the disclosure, and is not a comprehensive disclosure of its full scope or all of its features.

According to several embodiments of a gun mount of the present disclosure, a gun mount for mounting a weapon to a vehicle includes a weapon mount plate defining a planar surface. First and second side plates are oriented at an angle with respect to the planar surface of the weapon mount plate. Front and rear plates are oriented perpendicular to the weapon mount plate and the first and second side plates. A male tab extends from individual ones of both the first and second side plates or both the front and rear plates. A female slot is created in individual ones of both the first and second side plates or both the front and rear plates not having the male tab. The female slot is aligned to slidably receive the male tab with a freely extending portion of the male tab extending beyond the female slot. A tab weld joint is created at the freely extending portion of the male tab to fix the first and second side plates to the front and rear plates.

According to other embodiments, a gun mount for mounting a weapon to a vehicle includes a weapon mount plate defining a planar surface. First and second side plates are oriented at an angle with respect to the planar surface of the weapon mount plate. Front and rear plates are oriented perpendicular to the weapon mount plate and the first and second side plates supporting the weapon mount plate and fixed to the first and second side plates. A male tab extends from individual ones of both the first and second side plates. A female slot is created in individual ones of both the front and rear plates. The female slot is aligned to slidably receive the male tab with a freely extending portion of the male tab extending beyond the female slot. A tab weld joint is created at the freely extending portion of the male tab to fix the first and second side plates to the front and rear plates.

According to further embodiments, a gun mount for mounting a weapon to a vehicle includes a weapon mount plate defining a planar surface. A weapon is supported on and connected to the weapon mount plate. First and second side plates are oriented at an angle with respect to the planar surface of the weapon mount plate. Front and rear plates are oriented perpendicular to the weapon mount plate and the first and second side plates supporting the weapon mount plate and fixed to the first and second side plates. A plurality of male tabs extends from individual ones of both the first and second side plates. A plurality of female slots is created in individual ones of both the front and rear plates. The female slots are individually aligned to slidably receive individual ones of the male tabs with a freely extending portion of the male tabs extending beyond the female slots. A tab weld joint is created at the freely extending portion of the male tabs to fix the first and second side plates to the front and rear plates. A load created by a firing frequency of the weapon is incorporated in a calculated wall thickness of the first and second side plates and the front and rear plates and a quantity of the male tabs.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
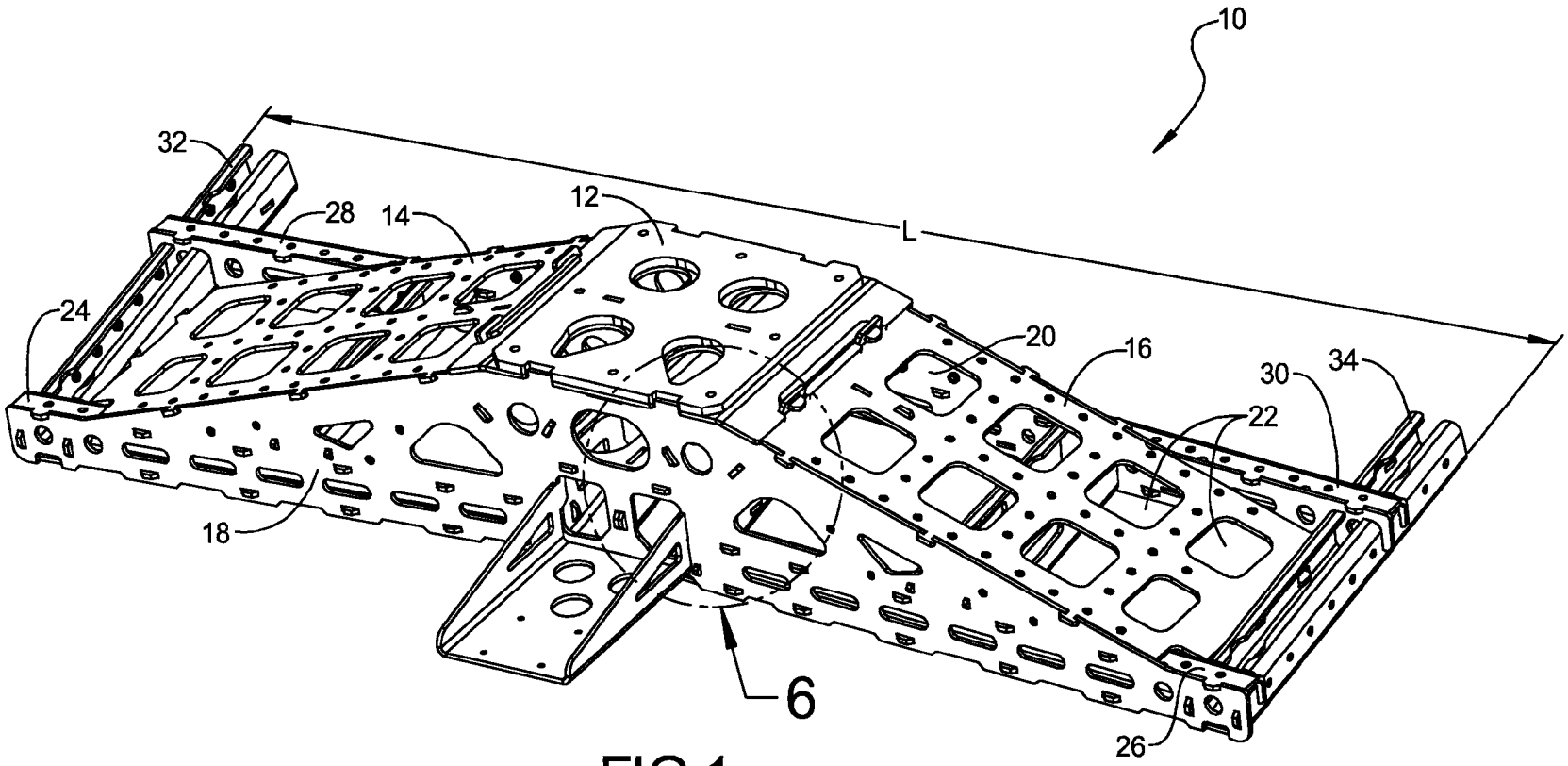
FIG. 1 is a front left perspective view of a gun mount of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a gun mount 10 is a framework of multiple plates which are joined, as will be described in reference to FIG. 3, and then intermittently welded. Gun mount 10 material is preferably made using aluminum or a similar lightweight metal material in lieu of a high strength steel material. A weapon mount plate 12 is connected to first and second side plates 14, 16 which angle outwardly and continuously downwardly away from an elevation of weapon mount plate 12 to distribute weapon weight and firing loads and stresses laterally outward from weapon mount plate 12. First and second side plates 14, 16 are substantially planar in shape. A substantially vertically oriented planar front plate 18 and a similar rear plate 20 are connected to both weapon mount plate 12 and front and rear edges of front and rear plates 18, 20. Front and rear plates 18, 20 distribute weapon weight and firing loads and stresses vertically downward and laterally outward from weapon mount plate 12. Each of the weapon mount plate 12, first and second side plates 14, 16 and front and rear plates 18, 20 have multiple apertures 22 of various geometries and sizes to reduce overall gun mount 10 weight.

Figure 10:
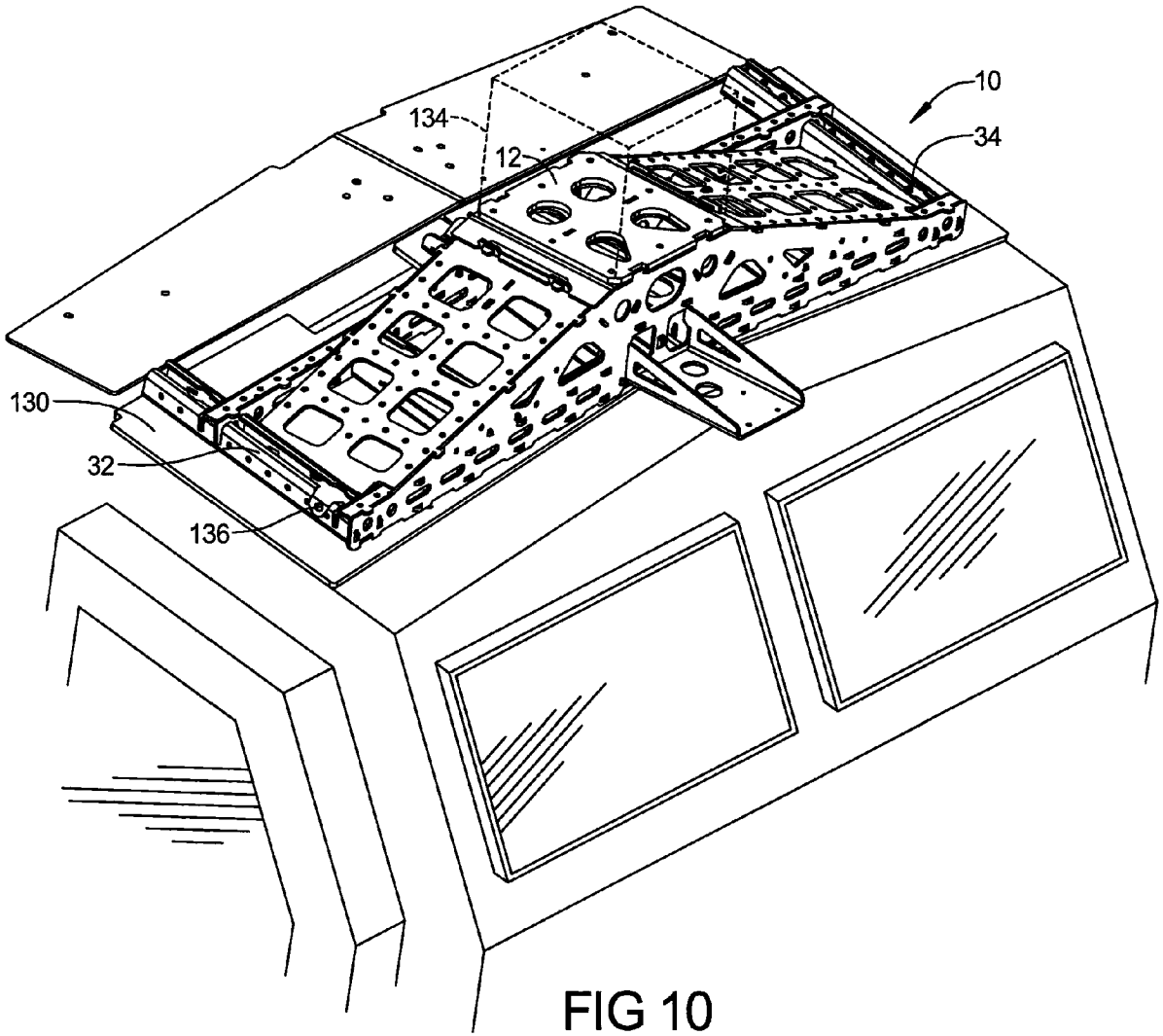
FIG. 10 is a front right perspective view of the gun mount of FIG. 1 mounted to a vehicle roof.

The front and rear plates 18, 20 are individually fixed to first and second channels 24, 26 and third and fourth channels 28, 30 respectively which extend laterally outwardly defining a total length "L" of the gun mount 10. The first and second channels 24, 26 are both connected to a first outrigger member 32, and the third and fourth channels 28, 30 are both connected to a second outrigger member 34 which can both be provided as C-shaped channels. The first and second channels 24, 26 are oriented parallel to and abut against front plate 18. The third and fourth channels 28, 30 are oriented parallel to and abut against rear plate 20. The first and second outrigger members 32, 34 are oriented perpendicular to the first and second channels 24, 26 and the third and fourth channels 28, 30. The first and second outrigger members 32, 34 further distribute the loads carried through the first and second side plates 14, 16, the front and rear plates 18, 20 and the channels 24, 26, 28, 30 and provide mounting connections to connect gun mount 10 to a vehicle which is shown and described in reference to FIG. 10.

Figure 2:
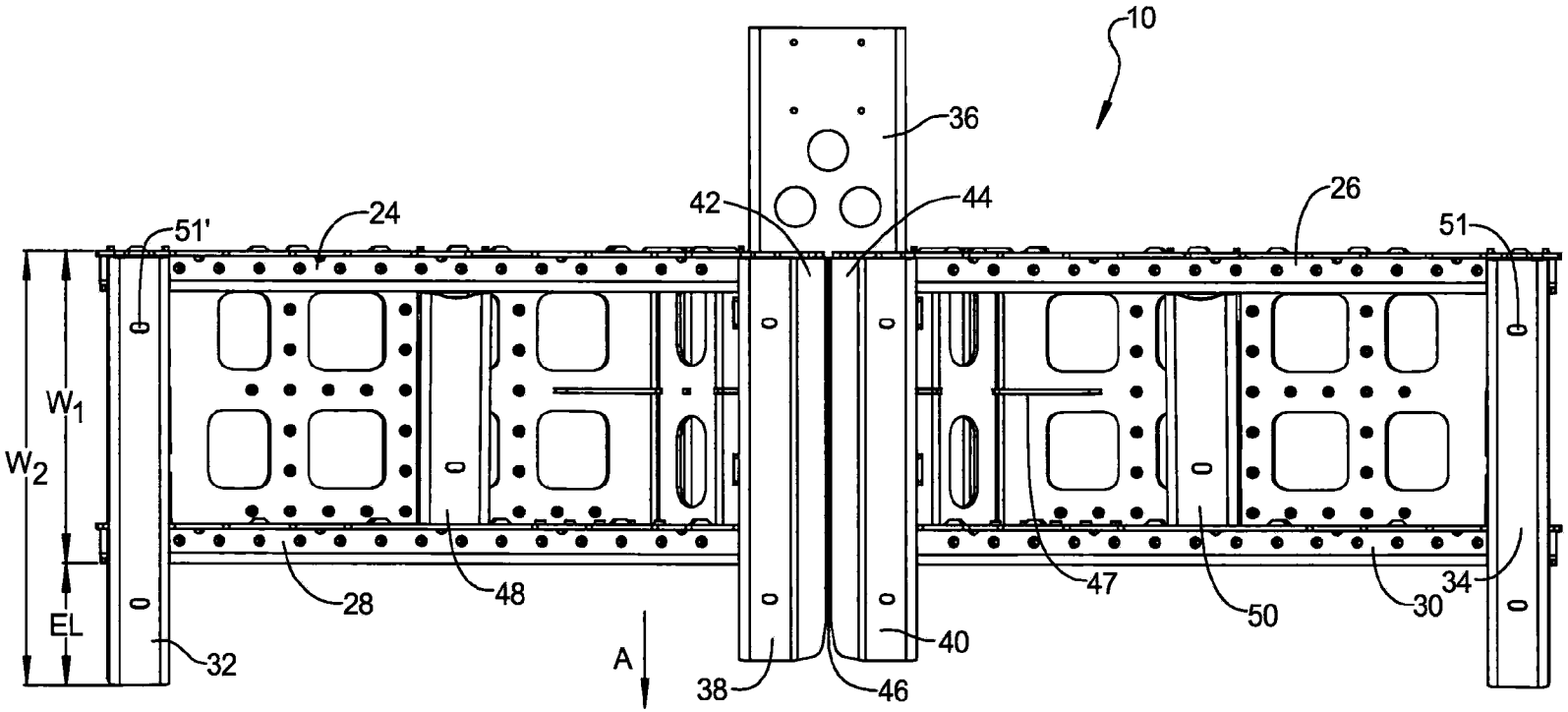
FIG. 2 is a bottom plan view of the gun mount of FIG. 1.

Referring to FIG. 2, a bracket 36 is fixed to and oriented perpendicular to front plate 18. Bracket 36 can be used to mount additional equipment such as a camera, laser sight, or weapon support (not shown). Bracket 36 is connected to front plate 18 by intermittent weld joints and using male tabs received in slots of front plate 18 which will be described in greater detail in reference to FIG. 6.

Generally U-shaped first and second central stiffening members 38, 40 are oriented perpendicular to front and rear plates 18, 20 and extend beyond rear plate 20 in a rearward direction "A" to increase a torsional stiffness of gun mount 10. First and second central stiffening members 38, 40 each includes an angled wing portion 42, 44 which are directed toward each other and upwardly toward weapon mount plate 12. An elevation peak 46 is created between first and second central stiffening members 38, 40 at the inward ends of angled wing portions 42, 44. A longitudinal support member 47 extends above the first and second central stiffening members 38, 40 and is positioned between the first, second, third and fourth channels 24, 26, 28, 30. Longitudinal support member 47 includes male tabs that are received in female slots of both the first and second side plates 14, 16 such that longitudinal support member 47 directly contacts an under-facing surface of both the first and second side plates 14, 16 to help minimize deflection of first and second side plates 14, 16. Longitudinal support member 47 also provides structural support for weapon mount plate 12. Additional mid-positioned first and second brace members 48, 50 are oppositely positioned with respect to each connected to first and second central stiffening members 38, 40. First brace member 48 is connected to each of first and third channels 24, 28. Second brace member 50 is connected to each of second and fourth channels 26, 30.

A first width "$W_1$" of gun mount 10 is defined between forward facing sides of first and second channels 24, 26 and rearward facing sides of third and fourth channels 28, 30. The lengths of first and second outrigger members 32, 34 define a second width "$W_2$" of gun mount 10. The forward ends of first and second outrigger members are aligned with the forward facing sides of first and second channels 24, 26. A width difference between second width "$W_2$" and first width "$W_1$" defines an extension length "EL" of the first and second outrigger members 32, 34 which provides additional torsional stiffness of gun mount 10 without the additional weight and cost of extending first width "$W_1$" in rearward direction "A" to achieve the desired torsional stiffness.

Figure 3:
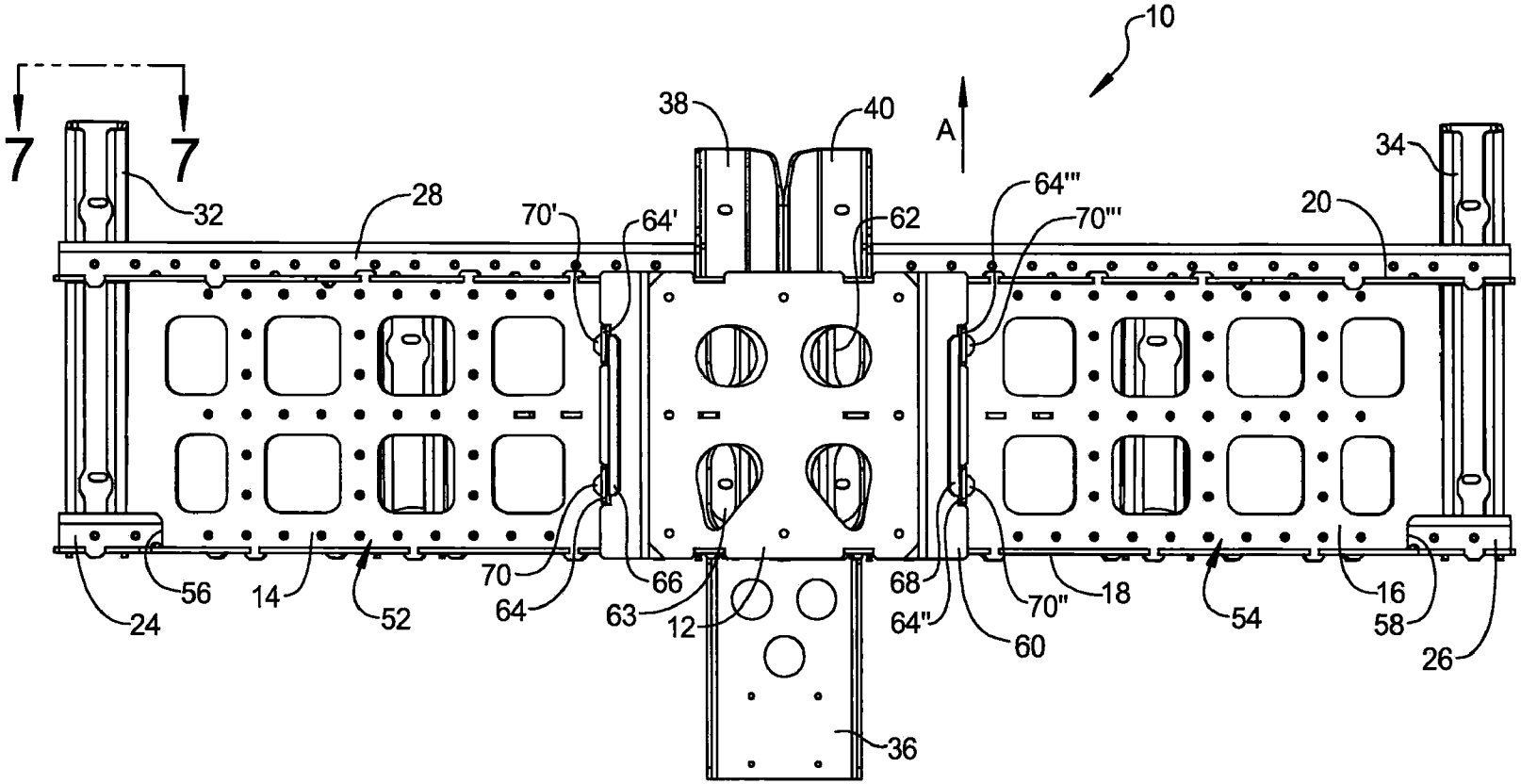
FIG. 3 is a top plan view of the gun mount of FIG. 1.

Referring to FIG. 3, first and second overlapping portions 52, 54 of first and second side plates 14, 16 individually overlap the first and second channels 24, 26 outward to a first and second notch 56, 58 created in first and second side plates 14, 16. First and second notches 56, 58 are located proximate to first and second outrigger members 32, 34. In contrast, according to several embodiments there is no overlap of first and second side plates 14, 16 with respect to rear plate 20. Rear plate 20 directly abuts a forward facing wall of each of third and fourth channels 28, 30 proximate to the first and second outrigger members 32, 34.

A connecting plate 60 is fixed to gun mount 10 directly below and directly supporting weapon mount plate 12. A support frame 62 is positioned below connecting plate 60 and extends between front and rear plates 18, 20 to provide additional support for weapon mount plate 12. Male tabs of support frame 62 (described in reference to FIG. 8) extend through female slots of both front and rear plates 18, 20 to connect support frame 62. A receiving frame 63 is positioned below and is connected to support frame 62. Male tabs 64, 64', 64", 64'" of receiving frame 63 extend upwardly through slots created in both connecting plate 60 and individual ones of the first and second side plates 14, 16. Identical first and second clip members 66, 68 each have male tabs 70, 70' and 70", 70'" respectively which are engaged through slots of the male tabs 64, 64', 64", 64'" of receiving frame 63 to mechanically connect receiving frame 63 to connecting plate 60 prior to welding.

Figure 4:
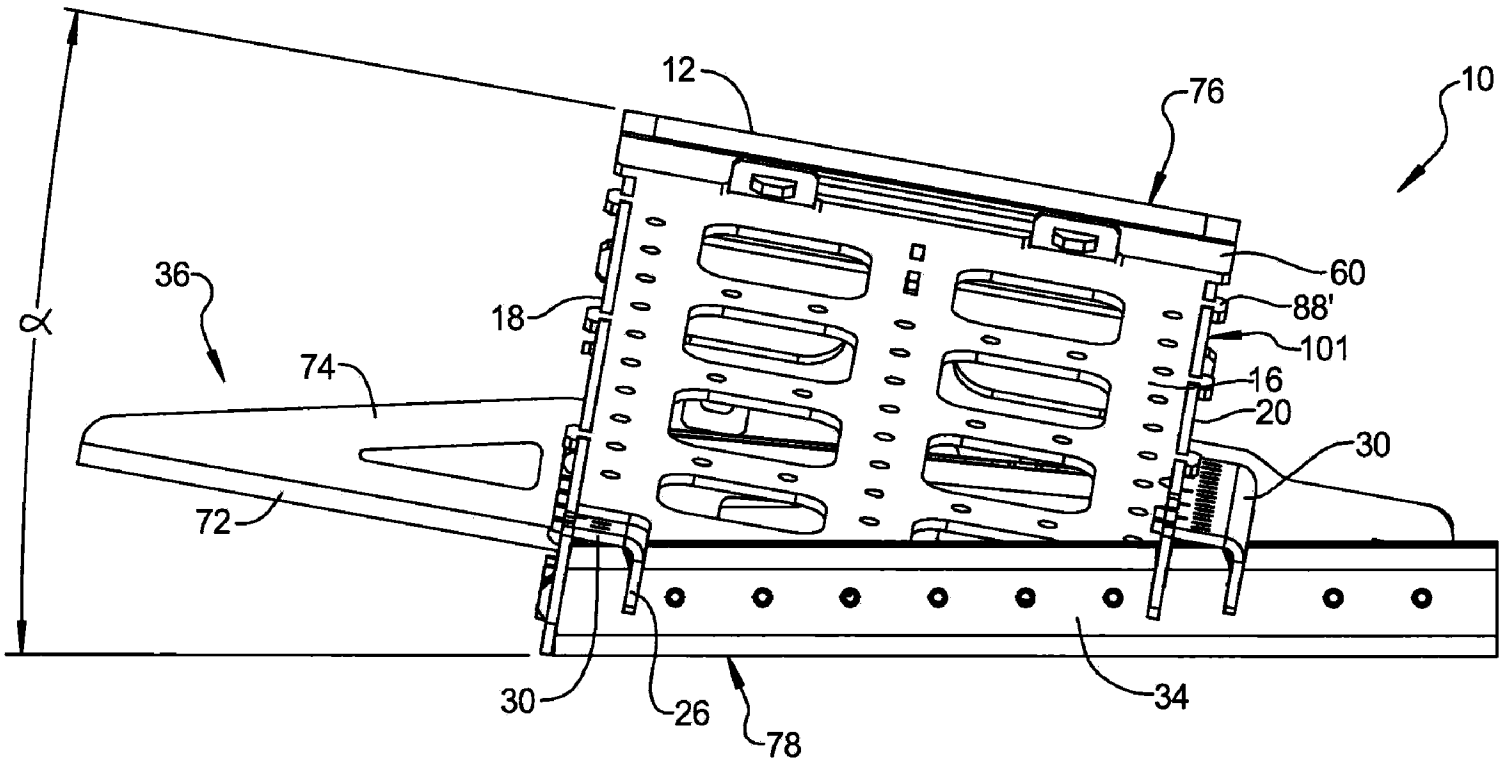
FIG. 4 is a left side elevational view of the gun mount of FIG. 1.

Referring to FIG. 4, bracket 36 includes opposed left and right side walls 74, 74' (only right side wall 74' is visible in this view) that taper away from the connection point of bracket 36 with respect to front plate 18. Bracket 36 further includes a planar bottom member 72 that can include one or more apertures for fasteners used to connect the item supported by bottom member 72. According to several embodiments bottom member 72 is oriented perpendicular to front plate 18 and parallel to an upper planar surface 76 of weapon mount plate 12. Weapon mount plate 12 according to several embodiments is oriented at an angle $\alpha$ with respect to a bottom face 78 of both first and second outrigger members 32, 34 which are oriented co-planar and therefore parallel to each other (only second outrigger member 34 is visible in this view). According to several embodiments, front plate 18 has a greater height that rear plate 20 which determines angle $\alpha$. The heights of front and rear plates 18, 20 and therefore angle $\alpha$ can vary to suit the geometry of the vehicle panel on which gun mount 10 is supported.

Figure 5:
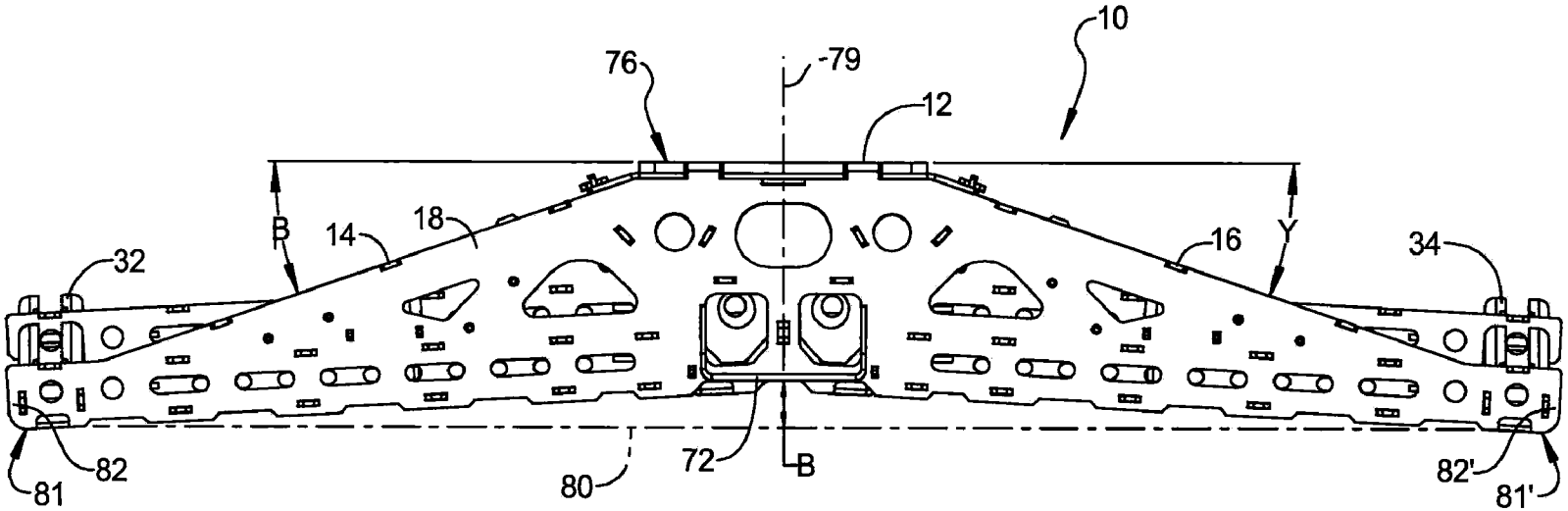
FIG. 5 is a front elevational view of the gun mount of FIG. 1.

Referring to FIG. 5, first side plate 14 is oriented at an angle $\beta$ with respect to planar surface 76 of weapon mount plate 12. Second side plate 16 is oriented at an angle $\gamma$ with respect to planar surface 76 of weapon mount plate 12. According to several embodiments, angle $\beta$ equals angle $\gamma$ and first and second outrigger members 32, 34 are equally spaced with respect to a central axis 79 of gun mount 10. this configuration is not limiting however, and angle $\beta$ can differ from angle $\gamma$ to accommodate different locations for weapon mount plate 12 on the vehicle. According to several embodiments bottom member 72 of bracket 36 can be elevated to an elevation dimension "B" with respect to a reference plane 80 extending between outer points 81, 81' of outer ends 82, 82' of front plate 18. Elevation dimension "B" can vary from zero to a height determined by the geometry of the vehicle roof on which gun mount 10 is mounted.

Figure 6:
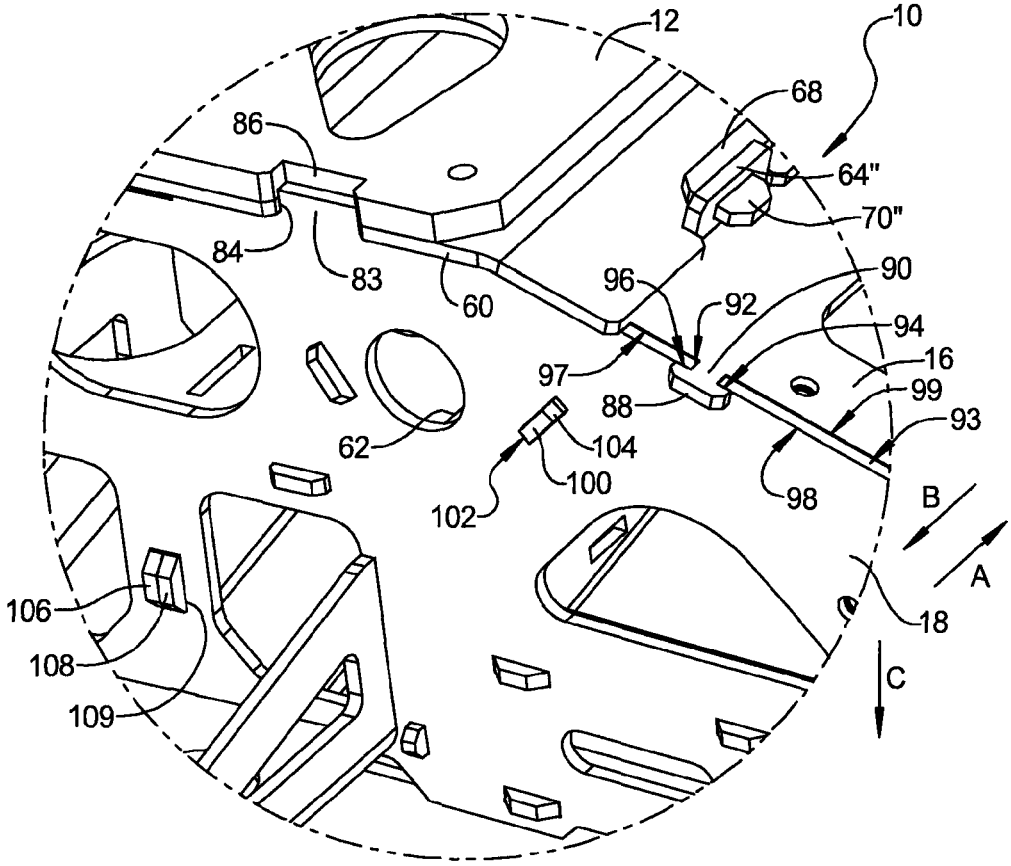
FIG. 6 is a front left perspective view taken at area 6 of FIG. 1.

Referring to FIG. 6, the various plates and component parts of gun mount 10 are mechanically "linked" before being fixed by intermittent weld joints. For example, each of the front and rear plates 18, 20 has one or more male tabs, such as a male tab 83 extending away from outer edges of the plates. Male tabs 83 are slidingly received in a correspondingly shaped first slot 84 of connecting plate 60 and a coaxially aligned second slot 86 of weapon mount plate 12. Male tabs 83 therefore lock both the connecting plate 60 and weapon mount plate 12 in alignment with each other. The use of tabs 83 and slots 84, 86 allows gun mount 10 to be sub-assembled and its dimensions confirmed before welding to fix the geometry. The tabs 83 and slots 84, 86 also transfer structural loads between the coupled plates and provide mechanical resistance to loads tending to separate the plates. The tabs 83 and slots 84, 86 also provide for alignment of the plates prior to welding without the need for or use of a fixture to hold all the plates, which speeds up and reduces the costs of the assembly process.

Additional geometries for the tabs and slots of the present disclosure include a T-shaped tab 88 which in the example shown is integrally and homogeneously connected to second side plate 16 and extends past front plate 18. T-shaped tab 88 includes a narrow neck 90 which slidingly fits into a slot 92 created in an upward facing edge 93 of front plate 18. First and second faces 94, 96 of T-shaped tab 88 abut against an outer face 98 of front plate 18 while at the same time an outer edge 97 of second side plate 16 abuts against an inner face 99 of front plate 18 to collectively "lock" front plate 18 to second side plate 16 and thereby prevent front plate 18 from moving in either of the rearward direction "A" or a forward direction "B". T-shaped tab 88 therefore provides a positive lock to resist outward displacement of the front plate 18 by carrying a tensile load in a lateral direction of the second plate 16 while at the same time neck 90 of T-shaped tab 88 carries a portion of a downwardly directed load in a load direction "C" from second side plate 16 to front plate 18. According to other embodiments, the T-shaped tabs 88 can be integrally connected to the front and rear plates 18, 20 with slots 92 created in the first and second plates 14, 16.

As best seen with further reference to both FIGS. 4 and 6, T-shaped tabs 88' are also integrally provided with the first and second side plates 14, 16 (only second side plate 16 is visible in FIG. 4) to connect first and second side plates 14, 16 to the rear plate 20. T-shaped tabs 88' engage an outer face 101 of the rear plate 20 in the same way that the outer face 98 of the front plate 18 is engaged.

Still other geometries for the tabs and slots include tapered tabs 100 which integrally and homogeneously extend from members of gun mount 10 such as support frame 62 in the example shown, which are slidingly received in rectangular shaped slots 102 for example created in front plate 18. Tapered tabs 100 include at least one tapered face 104 that assists in aligning the tabs for sliding into the slots 102. Tapered tabs 100 can also be used in multiple or ganged configurations, as shown with respect to tapered tabs 106, 108 which extend from two different components but abut together through a single, enlarged rectangular shaped slot 109.

Figure 7:
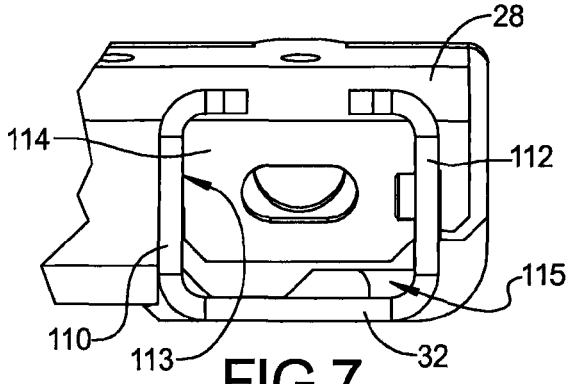
FIG. 7 is a rear elevational view taken at section 7 of FIG. 3.

Referring to FIG. 7, the first and second outrigger members 32, 34 have generally C-shaped bodies including opposed first and second walls 110, 112. To engage the ends of the first, second, third and fourth channels 24, 26, 28, 30 with the first and second outrigger members 32, 34, apertures 113 are cut or shaped to match the geometry of first and second walls 110, 112 creating portions 114 of the first, second, third and fourth channels 24, 26, 28, 30 that can be slidably received in a channel cavity 115 of first, second, third and fourth channels 24, 26, 28, 30 in a direction directed either toward or away from the viewer as seen in FIG. 7.

Figure 8:
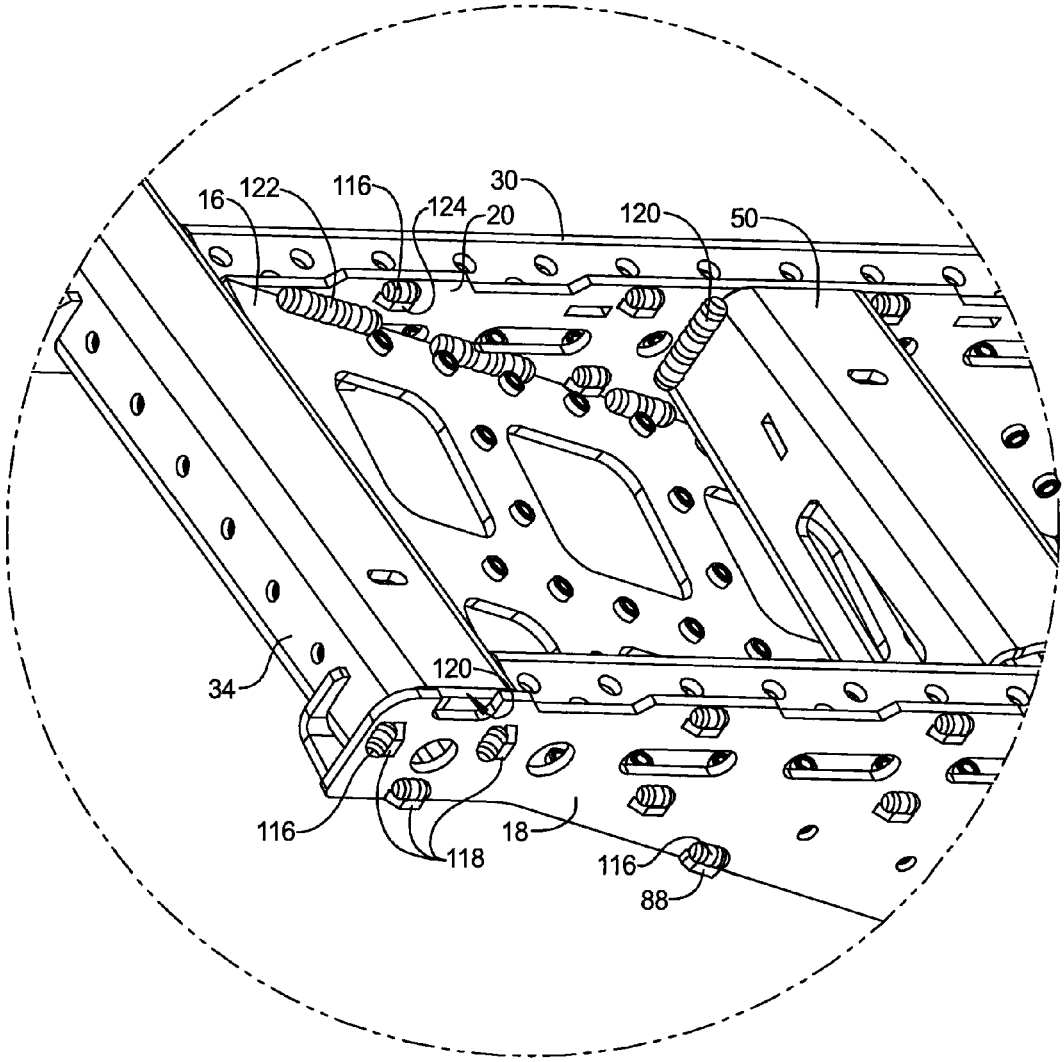
FIG. 8 is a bottom perspective view of a side plate portion of the gun mount of FIG. 1.

Referring to FIG. 8, because of the multiple uses of male tabs and slots to join members of the gun mount 10, continuous weld joints normally required to join the panels and connecting members can be substantially replaced by discontinuous or intermittent weld joints. Tab weld joints 116, similar to tack welds or fillet welds, are used to fix individual ones of each of the male tabs at least at freely extending portions 118 of each of the male tabs. Continuous weld joints 120 are minimized, and are used for example to connect second brace member 50 to an inner facing wall of rear plate 20. Intermittent weld joints 122 are used to fix plate-to-plate joints, such as to fix second side plate 16 to rear plate 20. Each of the first, second, third and fourth channels 24, 26, 28, 30 also includes male tabs 124, which are fixed using tab weld joints 116. Substantially all of the tabs, including T-shaped tabs 88 are fixed using tab weld joints 116.

Figure 9:
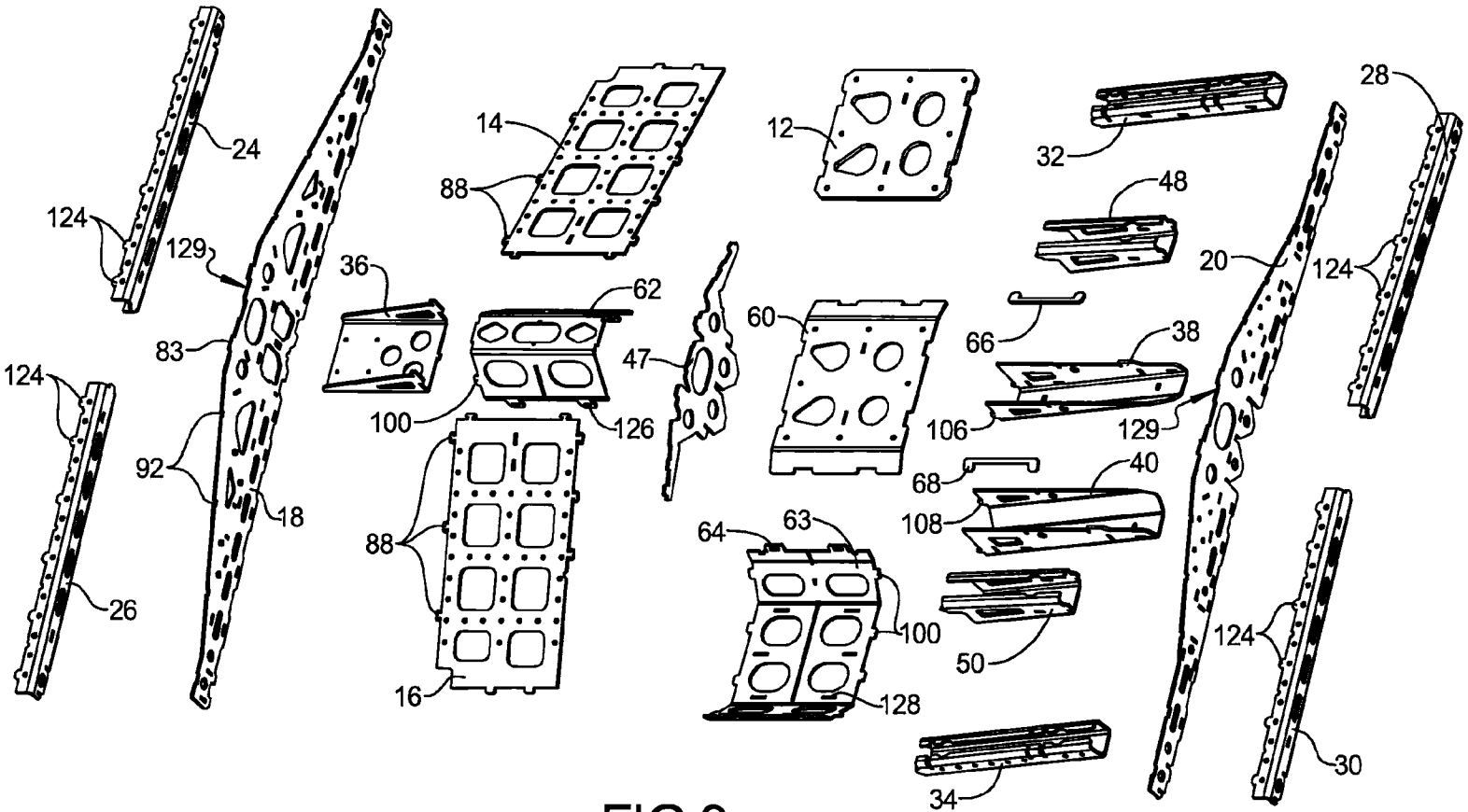
FIG. 9 is an exploded assembly view of the gun mount of FIG. 1.

Referring to FIG. 9, internal components of gun mount 10 include longitudinal support member 47 which includes male tabs received in slots of both support frame 62 and receiving frame 63. Support frame 62 is joined to receiving frame 63 using male tabs 126 received in slots 128 of receiving frame 63. The design of gun mount 10 using male tabs and female slots to a maximum extent permits the tabs and slots to be incorporated in the structural design, thereby allowing the plates to be stamped or cut to the geometries shown while minimizing wall thickness and weight. The use of male tabs and slots of the present disclosure also increases construction tolerances of gun mount 10 due to the sliding fit used for the tabs and slots, and also reduces the amount of continuous weld joint required for assembly of gun mount 10, thereby decreasing assembly time and cost. The front and rear plates 18, 20 each further includes a flat surface portion 129 which directly contact connecting plate 60, having tab 83 extending from the flat surface portion 129 received in slot 84 of connecting plate 60.

Referring to FIG. 10 and again to FIGS. 6 and 8, the gun mount 10 is shown connected to an armor roof plate 130 of a lightly armored vehicle 132. Because the armor roof plate 130 is generally thinner in these smaller vehicles to provide for a lower vehicle weight and increased operating range, gun mount 10 is designed to accommodate the natural or modal frequency of a weapon 134 mounted on gun mount 10, due not only to a weapon weight but also to its firing frequency. Fasteners 136 can be used to permit the gun mount to be removable. The operating loads 138 of the weapon 134 plus the weight of gun mount 10 do not overstress and/or yield roof plate 130. Roof plate 130 can also be reinforced roof plating material. The load created by the firing frequency of the weapon is further incorporated in a calculated wall thickness of the first and second side plates 14, 16, the front and rear plates 18, 20 and a quantity of the male tabs 88, 100.

Gun mounts 10 of the present disclosure provide the following advantages. A lightweight gun mount is provided for roof mounting to a military vehicle which uses aluminum material plates with apertures for weight reduction and channel members such as C-shaped channels for joining the plates and distributing the loads. The structure of tab and slot joints connecting the plates permits the tabs to be included in the structural analysis. Tab weld joints applied at each tab reduce a total amount of continuous weld joints required to assemble the gun mount. A natural or modal frequency of the gun mount accommodates both the weapon weight and its operating frequency, which allows the mount design to be optimized to minimize the operating load transferred to the roof of the vehicle. The use of outriggers oriented parallel to the vehicle roof or armor plating having connecting fasteners positioned between the outriggers and the vehicle roof or armor plating outwardly distributes the structural weight and weapon loads without increasing a width of the gun mount to the full length of the outriggers.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A gun mount for mounting a weapon to a vehicle, comprising:

a weapon mount plate defining a surface;

first and second side plates connected to and extending away from the weapon mount plate;

front and rear plates connected to the weapon mount plate and the first and second side plates;

a male tab extending from individual ones of both the first and second side plates or both the front and rear plates;

a female slot created in individual ones of either both the first and second side plates or both the front and rear plates not having the male tab, the female slot aligned to slidably receive the male tab with a freely extending portion of the male tab extending beyond the female slot; and a tab weld joint created at the freely extending portion of the male tab to fix the first and second side plates to the front and rear plates.

2. The gun mount of claim 1, further including first and second channels oriented parallel to and abutting against the front plate.

3. The gun mount of claim 2, further including third and fourth channels oriented parallel to and abutting against the rear plate.

4. The gun mount of claim 3, further including first and second outrigger members oriented perpendicular to the first and second channels and the third and fourth channels, the first outrigger member connected to the first and third channels and the second outrigger member connected to the second and fourth channels.

5. The gun mount of claim 1, wherein the male tab further defines a T-shaped tab having:

a neck which slidingly fits into a slot created in an upward facing edge of one of the front or rear plates; and first and second faces that abut against an outer face of the one of the front or rear plates while at the same time an outer edge of the first or second side plate abuts against an inner face of the front or rear plate to collectively "lock" the front plate to the first or second side plate or the rear plate to the first or second side plate and thereby prevent the front plate or the rear plate from moving in either of a rearward direction or a forward direction.

6. The gun mount of claim 1, further including a connecting plate fixed to the gun mount directly below and directly supporting the weapon mount plate.

7. The gun mount of claim 6, further including a support frame positioned below the connecting plate and extending between the front and rear plates, having male tabs of the support frame extending through female slots of both the front and rear plates to connect the support frame to the front and rear plates.

8. The gun mount of claim 6, further including:

a receiving frame having male tabs extending upwardly through female slots created in both the connecting plate and individual ones of the first and second side plates; and first and second clip members each having male tabs which are engaged through slots of the male tabs of the receiving frame to mechanically connect the receiving frame to the connecting plate.

9. The gun mount of claim 1, further including a longitudinal support member including male tabs received in female slots of both the first and second side plates such that the longitudinal support member directly contacts an under-facing surface of both the first and second side plates.

10. A gun mount for mounting a weapon to a vehicle, comprising:

a weapon mount plate defining a surface;

first and second side plates oriented at an angle with respect to the surface of the weapon mount plate;

front and rear plates oriented perpendicular to the weapon mount plate and the first and second side plates supporting the weapon mount plate and fixed to the first and second side plates;

a male tab extending from individual ones of both the first and second side plates;

a female slot created in individual ones of both the front and rear plates, the female slot aligned to slidably receive the male tab with a freely extending portion of the male tab extending beyond the female slot; and a tab weld joint created at the freely extending portion of the male tab to fix the first and second side plates to the front and rear plates.

11. The gun mount of claim 10, further including first and second channels oriented parallel to and abutting against the front plate, the first and second channels having male tabs extending through female slots of the front plate and welded to engage the first and second channels to the front plate.

12. The gun mount of claim 11, further including third and fourth channels oriented parallel to and abutting against the rear plate, the third and fourth channels having male tabs received through female slots of the rear plate and welded to engage the third and fourth channels to the rear plate.

13. The gun mount of claim 12, wherein the first, second, third and fourth channels define C-shaped channels.

14. The gun mount of claim 10, wherein the male tab has a T-shape including first and second faces that directly contact an outer face of the front and rear plates.

15. The gun mount of claim 10, wherein the male tab defines a tapered tab including at least one tapered face that assists in aligning the tapered tab for sliding into the female slot.

16. The gun mount of claim 10, further including first and second male tabs both abutting against each other and both inserted through a single modified slot created in one of the front or back plates and sized to receive both the first and second male tabs.

17. A gun mount for mounting a weapon to a vehicle, comprising:

a weapon mount plate defining a planar surface;

a weapon supported on and connected to the weapon mount plate;

first and second side plates oriented at an angle with respect to the planar surface of the weapon mount plate;

front and rear plates oriented perpendicular to the weapon mount plate and the first and second side plates supporting the weapon mount plate and fixed to the first and second side plates;

a plurality of male tabs extending from individual ones of both the first and second side plates;

a plurality of female slots created in individual ones of both the front and rear plates, the female slots individually aligned to slidably receive individual ones of the male tabs with a freely extending portion of the male tabs extending beyond the female slots; and a tab weld joint created at the freely extending portion of the male tabs to fix the first and second side plates to the front and rear plates;

a load created by a firing frequency of the weapon incorporated in a calculated wall thickness of the first and second side plates and the front and rear plates and a quantity of the male tabs.

18. The gun mount of claim 17, further including a connecting plate fixed to the gun mount directly below and directly supporting the weapon mount plate.

19. The gun mount of claim 18, wherein the front and rear plates each further includes a flat surface portion directly contacting the connecting plate, having a male tab extending from the flat surface portion received in a first slot of the connecting plate and an aligned second slot of the weapon mount plate to align the connecting plate to the weapon mount plate.

20. The gun mount of claim 17, further including a bracket fixed to and oriented perpendicular to the front plate having male tabs received in slots of the front plate and fixed to the front plate using tab weld joints.

* * * * *